US006772538B2

(12) United States Patent
Vagedes

(10) Patent No.: US 6,772,538 B2
(45) Date of Patent: Aug. 10, 2004

(54) DRYER VENT

(75) Inventor: Michael Vagedes, Florence, KY (US)

(73) Assignee: Bluegrass Products, LLC, Erlanger, KY (US)

( * ) Notice: Subject to any disclaimer, the term of this patent is extended or adjusted under 35 U.S.C. 154(b) by 0 days.

(21) Appl. No.: 10/277,034

(22) Filed: Oct. 21, 2002

(65) Prior Publication Data

US 2004/0074105 A1 Apr. 22, 2004

(51) Int. Cl.[7] ..... F26B 11/02
(52) U.S. Cl. ..... 34/606; 454/359
(58) Field of Search ..... 34/201, 235, 606; 454/5, 6, 353, 359, 328, 337

(56) References Cited

U.S. PATENT DOCUMENTS

| | | | | |
|---|---|---|---|---|
| 181,272 A | | 8/1876 | Lane | |
| 914,134 A | | 3/1909 | Galitz | |
| 949,009 A | | 2/1910 | Smith | |
| 1,520,742 A | | 12/1924 | Basman | |
| 2,754,748 A | | 7/1956 | Daggett | |
| 3,181,451 A | | 5/1965 | Hess | |
| 4,122,612 A | * | 10/1978 | Mrofchak | 34/86 |
| 4,237,621 A | | 12/1980 | Boismenu | |
| 4,338,731 A | | 7/1982 | Shames et al. | |
| 4,654,198 A | * | 3/1987 | Beradini | 422/124 |
| 4,967,490 A | | 11/1990 | Berger et al. | |
| 5,046,408 A | * | 9/1991 | Eugenio | 98/119 |
| 5,081,913 A | | 1/1992 | Gervais | |
| 5,346,428 A | * | 9/1994 | Robinson, Jr. | 454/328 |
| 5,568,947 A | | 10/1996 | Paquette | |
| 5,632,678 A | * | 5/1997 | Doelfel | 454/366 |
| 5,662,522 A | * | 9/1997 | Waltz | 454/359 |
| 5,860,858 A | * | 1/1999 | Wettergren | 454/343 |
| 5,916,023 A | | 6/1999 | Meyer | |
| 6,103,201 A | * | 8/2000 | Green | 422/124 |
| 6,361,433 B1 | * | 3/2002 | Gray | 454/358 |
| 6,443,834 B1 | * | 9/2002 | Berger | 454/353 |

FOREIGN PATENT DOCUMENTS

| | | |
|---|---|---|
| CA | 184828 | 11/1876 |
| GB | 2065 | of 1795 |
| GB | 179819 | 5/1922 |
| GB | 374703 | 6/1932 |
| GB | 403183 | 12/1933 |
| JP | 362294826 A | 12/1987 |

* cited by examiner

*Primary Examiner*—Camtu Tran Nguyen
(74) *Attorney, Agent, or Firm*—Wood, Herron & Evans, L.L.P.

(57) ABSTRACT

A dryer vent designed to prevent bird and rodent ingress through the vent and further to prevent lint build-up includes a flap which has an edge portion recessed within the main body of the vent preventing birds and rodents from grasping the flap and opening it. Further, the dryer vent includes a rotating member such as a paddlewheel or a fan blade which rotates in response to air flowing through the vent thereby frightening birds and rodents.

7 Claims, 2 Drawing Sheets

DRYER VENT

BACKGROUND

Household clothes dryers are typically vented through an exterior wall. The exterior opening is in turn generally covered by a hood or flaps. This prevents water from entering through the opening. Two problems that are typically encountered with dryer vents are lint build-up and bird and rodent ingress into the opening. Birds frequently will set up nests in the opening which in turn blocks the openings. Various guards and grills have been used to prevent this. Unfortunately these tend to accumulate lint which must be removed in order to ensure proper air flow. Both of these problems are even more significant when the vents are mounted above ground level and one does not have easy access to the dryer vent.

SUMMARY OF THE INVENTION

The present invention is premised on the realization that a dryer vent which prevents rodents and birds from entering the opening and does not build up lint can be provided by incorporating a moving or rotating object in the air path which is caused to move or rotate by the exhaust air from the dryer.

Further, the present invention utilizes a flap which is opened in response to this moving air. The flap has an outer edge which is recessed or protected to prevent a bird or rodent from grasping the edge of the flap, opening it and permitting access.

The objects and advantages of the present invention will be further appreciated in light of the following detailed description and drawings in which:

DETAILED DESCRIPTION

Figure 1:
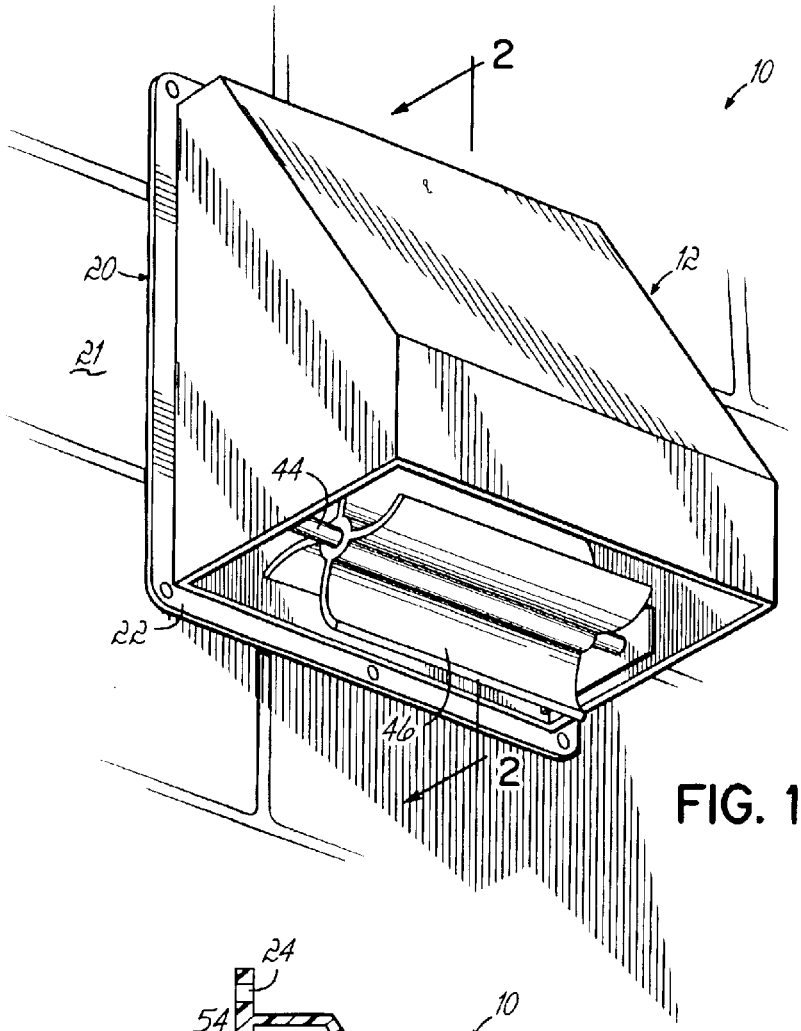
FIG. 1 is a perspective view of a first embodiment of the present invention.

The present invention is a dryer vent 10 having a front hood portion 12 and a rear circular edge 16 which defines a circular opening 18. The hood is designed to face the exterior of a building and the edge 16 is extended through an opening (not shown) in the building. Between the hood portion 12 and the edge portion 16 is a plate portion 20 which defines opening 18.

Plate 20 includes an exterior flange 22 which provides a method to attach the vent 10 to the side 21 of a house. As shown, the edge 22 includes a plurality of nail holes 24. Surrounding the opening on the outwardly facing side of plate 20 is a circular lip 26 which encircles at least the lower portion of the opening 18. As shown, lip 26 extends from a left side 28 of hinge 34 to the right side 30.

The vent further includes a circular flap 32 which attaches to the main plate 20 at hinge structure 34. This allows the flap 32 to rotate in the direction of arrow 36.

Flap 32 further includes a peripheral edge 48 which has a depth less than or equal to the depth of lip 26. Thus when the flap is closed, its outboard edge is protected by lip 26. In other words, lip 26 provides a portion of the plate that extends to the outer edge 48 of flap 32 or further preventing birds from grasping the edge 48 of the flap and opening it when the dryer is not in use.

First and second tabs 38 and 40 extend from a lower extension portion 42 of plate 20 outwardly towards hood 12. A shaft 44 runs between tabs 38 and 40. As shown in FIG. 1, a paddlewheel fan blade 46 is rotably attached to shaft 44 permitting it to rotate freely. Alternatively, shaft 44 could be mounted to the side walls of the hood.

To install the vent of the present invention, the rear edge 16 is attached to a conduit not shown which in turn is attached to the dryer exhaust. This tube can snap fit between edge 16 and lip 54 holding it in position. Nails or screws can be inserted through holes 24 holding the vent in position on the side 21 of the house.

When the dryer is hooked up to this device, hot air will blow outwardly forcing the flap 32 to rotate in the direction of arrow 36 allowing the air to exhaust outwardly. This will also cause paddlewheel 46 to rotate which in turn will frighten rodents and birds, keeping them from attempting to enter the exhaust vent when the dryer is running.

Figure 2:
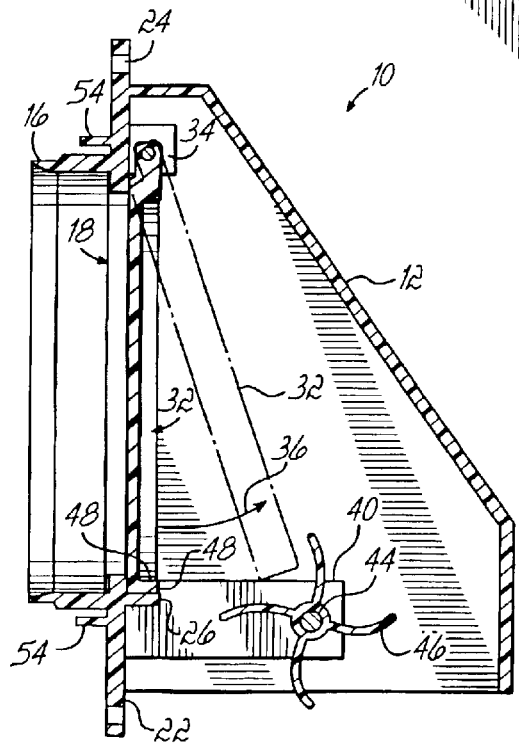
FIG. 2 is a cross-sectional view taken at lines 2—2 of FIG. 1.
Figure 3:
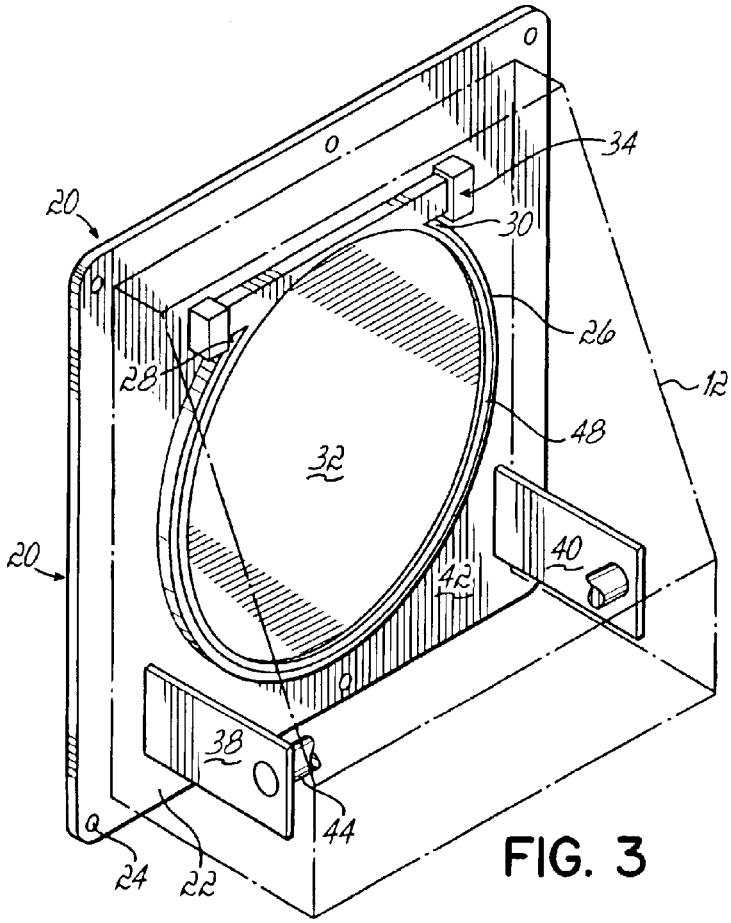
FIG. 3 is a perspective view of the vent shown in FIG. 1 partially in phantom and partially broken away.

When the dryer is no longer operating, the flap 32 will fall back to the position shown in FIGS. 2 and 3 sealing the opening. Since the outer edge 48 of the lower portion of flap 32 is coterminous or even recessed within plate 20 (i.e., protected by lip 26), birds and rodents cannot easily grasp the edge 48 to open it and in fact would most likely attempt to pull on edge 26 to open the flap 32. The upper portion of the flap 32 (although shown concealed) does not necessarily have to be protected as the rodents and birds cannot easily grasp the upper portion. However it is preferred to have this protective lip 26 extend substantially around the flap up to the hinge portion. The lip 26 can be removed and the flap 32 can simply be recessed in plate 20.

Since the fan wheel 46 can rotate easily, the flap 32 can open and engage the fan wheel 46. Further, when the exhaust through the vent is discontinued, the fan wheel will allow the flap 32 to close.

Figure 4:
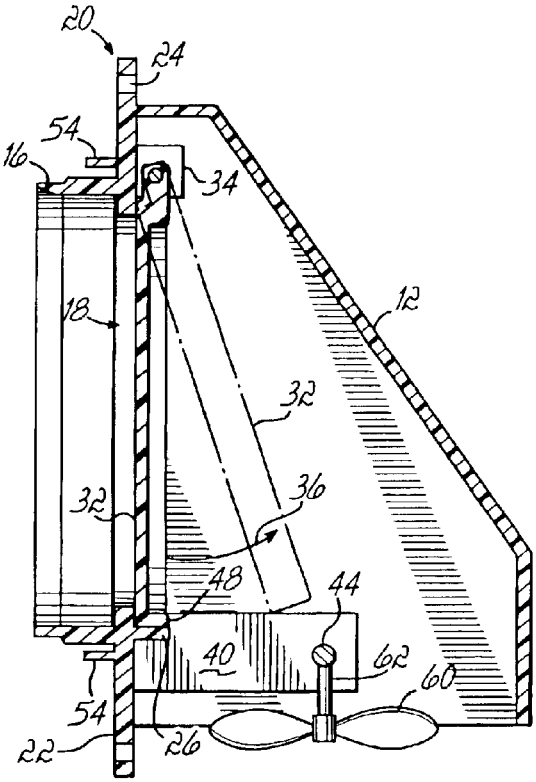
FIG. 4 is a cross-sectional view of an alternate embodiment of the present invention.

FIG. 4 shows an alternate embodiment of the present invention. Since the purpose of the invention is simply to maintain something in rotation in the open portion of the vent to deter rodents and birds from entering, this utilizes an alternate moving structure specifically this is a fan blade 60 rotably attached to a central shaft 62 which is in turn fixed to shaft 44 as shown in FIG. 3. Since both fan blades 46 and 60 rotate when the exhaust is blowing through the vent, lint does not tend to build up on the structures. Thus, even though they are directly in the air path, they do not accumulate lint.

Although it is preferred to incorporate both a rotatable object and a protected flap edge in the vent, either of these features will independently deter rodents and birds from entering the exhaust opening 18. Further, other movable structures other than the paddlewheel and fan blade shown in the Figures can be used to provide the same benefit as long as they are designed to move continuously in response to the air flow and preferably rotate in response to the air flow.

This has been a description of the present invention along with the preferred method of practicing the invention, however, the invention itself should only be defined by the appended claims wherein we claim.

I claim:

1. A dryer vent having a main plate said main plate defining an exhaust opening, a hood attached to said main plate and covering said opening, a flap hingedly attached to said vent and adapted to seal said main opening and a rotating structure attached to said dryer vent and adapted to rotate continuously while air passes through said vent.

2. A dryer vent claimed in claim 1 wherein said flap has an outboard edge and wherein said outboard edge is protected by said main plate.

3. A dryer vent claimed in claim 2 wherein said main plate includes a lip surrounding said opening said lip extending outwardly at least to the outboard edge of said flap.

4. A dryer vent claimed in claim 1 further comprising a first and second tab extending from said main plate, a shaft between said main plate and a rotating structure attached to said shaft wherein said structure rotates in response to air passing through said vent.

5. A dryer vent claimed in claim 4 wherein said rotating structure comprises a paddlewheel rotably mounted on said shaft.

6. A dryer vent claimed in claim 4 wherein said rotating structure comprises a fan blade having an axial shaft said axial shaft fixed to said shaft extended between said first and second tabs.

7. A dryer vent claimed in claim 1 wherein said rotating structure is a paddlewheel.

* * * * *